US005817963A

United States Patent [19]

Fravel et al.

[11] Patent Number: 5,817,963

[45] Date of Patent: Oct. 6, 1998

[54] VOCAL NOTE INDICATOR DEVICE

[75] Inventors: Gary Lee Fravel, Decatur; Dave Kuhajda, Waterloo, both of Ind.

[73] Assignee: Fravel Sound Industries, Inc., Decatur, Ind.

[21] Appl. No.: 583,280

[22] Filed: Jan. 5, 1996

[51] Int. Cl.[6] ..... G09F 13/00; G10G 1/00; G10G 7/02

[52] U.S. Cl. ..... 84/454; 84/477 R; 84/453; 340/815.45; 340/815.46

[58] Field of Search ..... 84/454, 477 R, 84/478, 453; 340/815.45, 815.46

[56] References Cited

U.S. PATENT DOCUMENTS

| | | | |
|---|---|---|---|
| 4,144,581 | 3/1979 | Prudente | 364/827 |
| 4,271,746 | 6/1981 | Doobie | 84/454 |
| 4,281,577 | 8/1981 | Middleton | 84/454 |
| 4,321,853 | 3/1982 | Tumblin | 84/454 |
| 4,327,623 | 5/1982 | Mochida et al. | 84/454 |
| 4,429,609 | 2/1984 | Warrender | 84/454 |
| 4,434,697 | 3/1984 | Roses | 84/454 |
| 4,580,133 | 4/1986 | Matsuoka et al. | 340/701 |
| 4,688,464 | 8/1987 | Gibson et al. | 84/454 |
| 4,796,509 | 1/1989 | Mizuguchi et al. | 84/454 |
| 5,056,398 | 10/1991 | Adamson | 84/454 |
| 5,287,789 | 2/1994 | Zimmerman | 84/477 R |
| 5,396,827 | 3/1995 | Miller et al. | 84/454 |

*Primary Examiner*—William M. Shoop, Jr.
*Assistant Examiner*—Marlon T. Fletcher
*Attorney, Agent, or Firm*—Randall J. Knuth

[57] ABSTRACT

The invention is directed to a vocal note indicating device for indicating the note of a vocal pitch signal. The device includes an amplifying means for amplifying an inputted vocal pitch signal and a square wave generator means. The square wave generator means is responsive to the vocal pitch signal from the amplifying means, and provides a square wave output signal substantially having a same period as the vocal pitch signal. A timer means is utilized for determining the period of the square wave and provides an output indicating a period of the square wave output signal. The device uses a microprocessor having a look-up table associated therewith to compare the output from the timer means with the look-up table to provide an output indicating the note and degree of at least one of sharpness and flatness of the inputted vocal pitch signal. A display means includes a plurality of columns of LEDs for displaying the note of the vocal pitch signal. The note is displayed as an illuminated LED from the plurality of columns of LEDs, with the degree of sharpness or flatness being represented as other illuminated LEDs in the same column.

13 Claims, 4 Drawing Sheets

90
D0 D1 D2 D3 D4 D5 D6 D7
A0 A1 A2 A3 A4 A5 A6 A7 A8 A9 A10 A11
CE
OE/VPP
80
A0 A1 A2 A3 A4 A5 A6 A7 A8 A9 A10 A11 A12 A13 A14 A15
D0 D1 D2 D3 D4 D5 D6 D7
M1
MREQ
IORQ
WR
RD
REFSH
HALT
WAIT
INT
NMI
RESET
BUSRQ
BUSAK
CLK
Vcc
GND
100
Q1 Q2 Q3 Q4 Q5 Q6 Q7 Q8
D1 D2 D3 D4 D5 D6 D7 D8
C
OC
101
98
97
99
94
92
96
52
Vcc
4Mhz OSC
50
104
106
107
5V Vcc
82
84

VOCAL NOTE INDICATOR DEVICE

BACKGROUND OF THE INVENTION

1. Field of the Invention

The present invention relates to an electronic pitch analyzer, and, more particularly, to such an analyzer for determining the pitch of a human voice.

2. Description of the Related Art

In the past, electronic musical tuning devices have been provided for the tuning of instruments whereby the desired tone is set manually in the device and the input of the device is compared with the set tone. This type of apparatus has the disadvantage that each note must be individually set which is tedious and time consuming.

Other types of electrical musical tuning instruments such as disclosed in U.S. Pat. No. 5,056,398 to Adamson, relate to a digital signal processing apparatus for identifying the octave, note and cent of a musical sound.

It is believed that no prior system has been created to identify to a singer, the frequency and pitch of their own voice tone, particularly in a live singing engagement having numerous background musical instruments. Humans have a voice tone that is substantially a sine wave.

What is needed in the art is a signal processor that may discern the human voice from a live background environment and determine and display the total qualities of the singer's voice in a substantially real time fashion.

SUMMARY OF THE INVENTION

The voice indicator system of the present invention solves the aforementioned problem by a plurality of signal processing device. A voice signal with accompanying background musical signals may be particularly identified and processed from the background music.

An advantage of the present indicator system of the present invention is that it is able to discern vocal tones in a live environment with background musical instrumentation even to the point where the background music is loud, up to and including noise to approximately 107 db. Even at this level the device is still active only on the voice track on the input signal. The particular combination of the natural frequency roll off of the amplifier, and a Schmitt trigger sub-circuit with a particular digital level accuracy selection determines the natural selectivity of the device.

Another advantage is that the visual display indicators continuously light and follow one's voice while singing and maintain the last note afterward. This is an improvement to prior musical instrument tuning systems that were only able to hold and display one note and then went blank on the halting of the note.

Yet another advantage of the present invention is that it rejects sections of particular harmonics of notes, particularly from musical instruments, thereby only processing the primary harmonic of an inputted note, normally the sine wave from a human voice. By rejecting harmonics, compensation is available for vibrato and other problems with the human voice.

The invention, in one form thereof, comprises a vocal note indicating device for indicating the note of a vocal pitch signal. The device includes an amplifying means for amplifying an inputted vocal pitch signal and a square wave generator means. The square wave generator means is responsive to the vocal pitch signal from the amplifying means, and provides a square wave output signal substantially having a same period as the vocal pitch signal. A timer means is utilized for determining the period of the square wave and provides an output indicating a period of the square wave output signal. The device uses a microprocessor having a look-up table associated therewith to compare the output from the timer means with the look-up table to provide an output indicating the note and degree of at least one of sharpness and flatness of the inputted vocal pitch signal. A display means includes a plurality of columns of LEDs for displaying the note of the vocal pitch signal. The note is displayed as an illuminated LED from the plurality of columns of LEDs, with the degree of sharpness or flatness being represented as other illuminated LEDs in the same column.

The invention, in another form thereof, comprises a vocal note indicating device for indicating the note of a vocal pitch signal. The device includes an amplifying means for inputting and amplifying the vocal pitch signal to the device along with a square wave generator means, responsive to the vocal pitch signal from the amplifying means. The square wave generator means provides a square wave output signal substantially having a same period as the vocal pitch signal. A timer means is utilized for determining the period of the square wave, and providing an output indicating a period of the square wave output signal. The timer means output has a representation having a significant bit and less significant bits.

A microprocessor having a look-up table associated therewith is utilized for obtaining the output of the timer means and then comparing two subsequent outputs of the timer means to determine if the two subsequent outputs have the same pre-selected significant bit. If so the microprocessor averages the less significant bits of the two subsequent outputs, and takes the averaged less significant bits and the significant bit of the two subsequent timer means outputs and indexes into the look-up table to provide an output indicating the note and degree of at least one of sharpness and flatness of the vocal pitch signal. A display means is used for displaying the note of the vocal pitch signal.

The invention, in yet another form thereof, includes a method of determining the note of a voice pitch signal, comprising the steps of: amplifying the voice pitch signal; converting the amplified voice pitch signal to a square wave having substantially the same period as the voice pitch signal; determining the period of two subsequent square wave signals; storing the two subsequent square wave signals in registers; comparing the most significant bit of the two subsequent square wave signals and accepting the signals if the most significant bits are the same; averaging the least significant bits of the two subsequent square waves and storing them with the accepted most significant bit in a register; indexing with the most significant and the averaged least significant bits into a look up table to obtain a display pattern which indicates the note and pitch of the voice pitch signal; and then sending the display pattern to a display device to display the note and pitch of the voice pitch signal.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
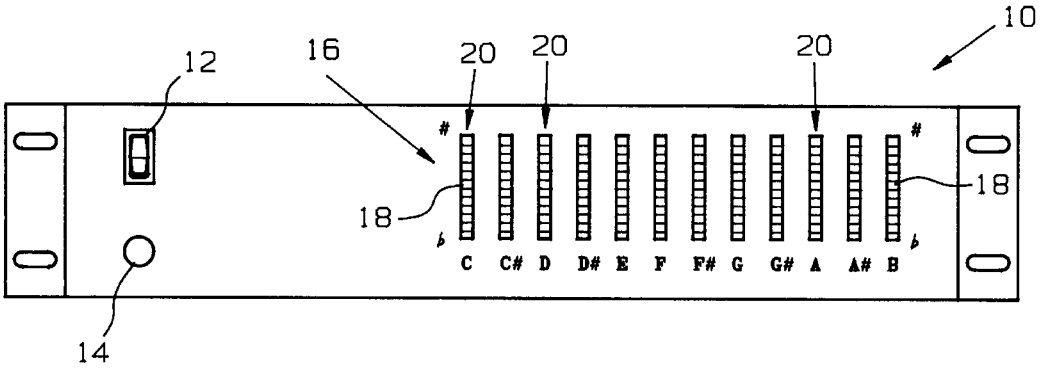
FIG. 1 is a front view of one form of the vocal note indicator device of the present invention.

Referring now to the drawings and particularly to FIG. 1, there is shown a vocal note indicator device 10 of the present invention. Device 10 includes an ON/OFF power switch 12, a sensitivity potentiometer 14, and an indicator bank 16.

Indicator bank 16 includes columns and rows of LEDs 18, each column 20 representing a particular chromatic note. In each column 20, the center two LEDs when activated, emit the color green while the next three adjacent LEDs above and below the center two LEDs emit the color yellow. The next two LEDs 18 above and below the set of green and yellow LEDs 18 emit the color red. These LEDs 18 are lit up on particular voice inputs to signify to a singer or operator that although the voice input may be a particular chromatic note, such as C for example if the first column has an LED 18 that is lit, the LEDs 18 show whether or not the input signal is flat or sharp based upon which LED 18 is illuminated. LEDs 18 indicate the pitch of the input tone, not the relative loudness (Db) of the tone.

Figure 2:
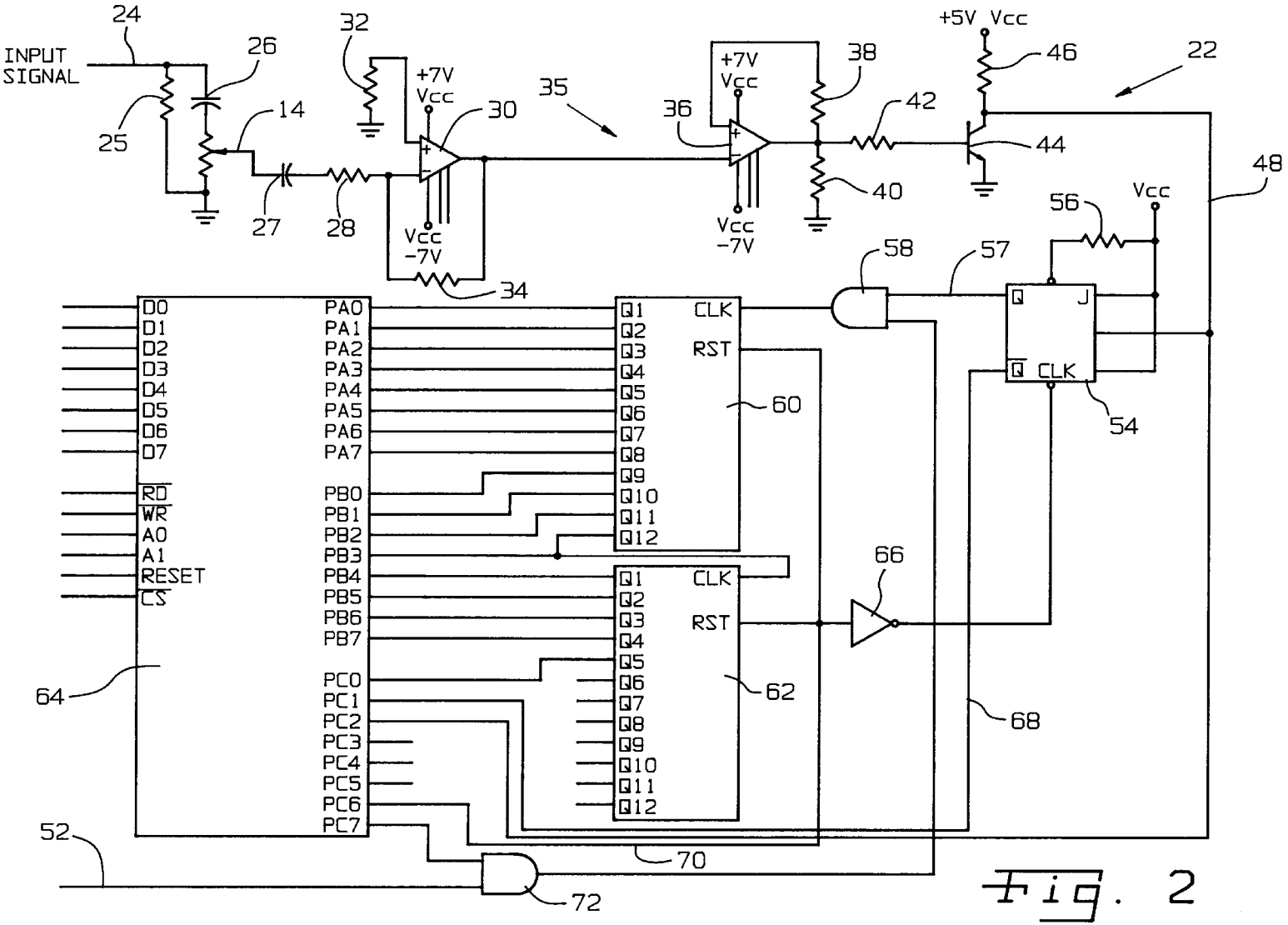
FIG. 2 is a schematic view of an embodiment of the input and frequency determination sub-circuit of the present invention.
Figure 3:
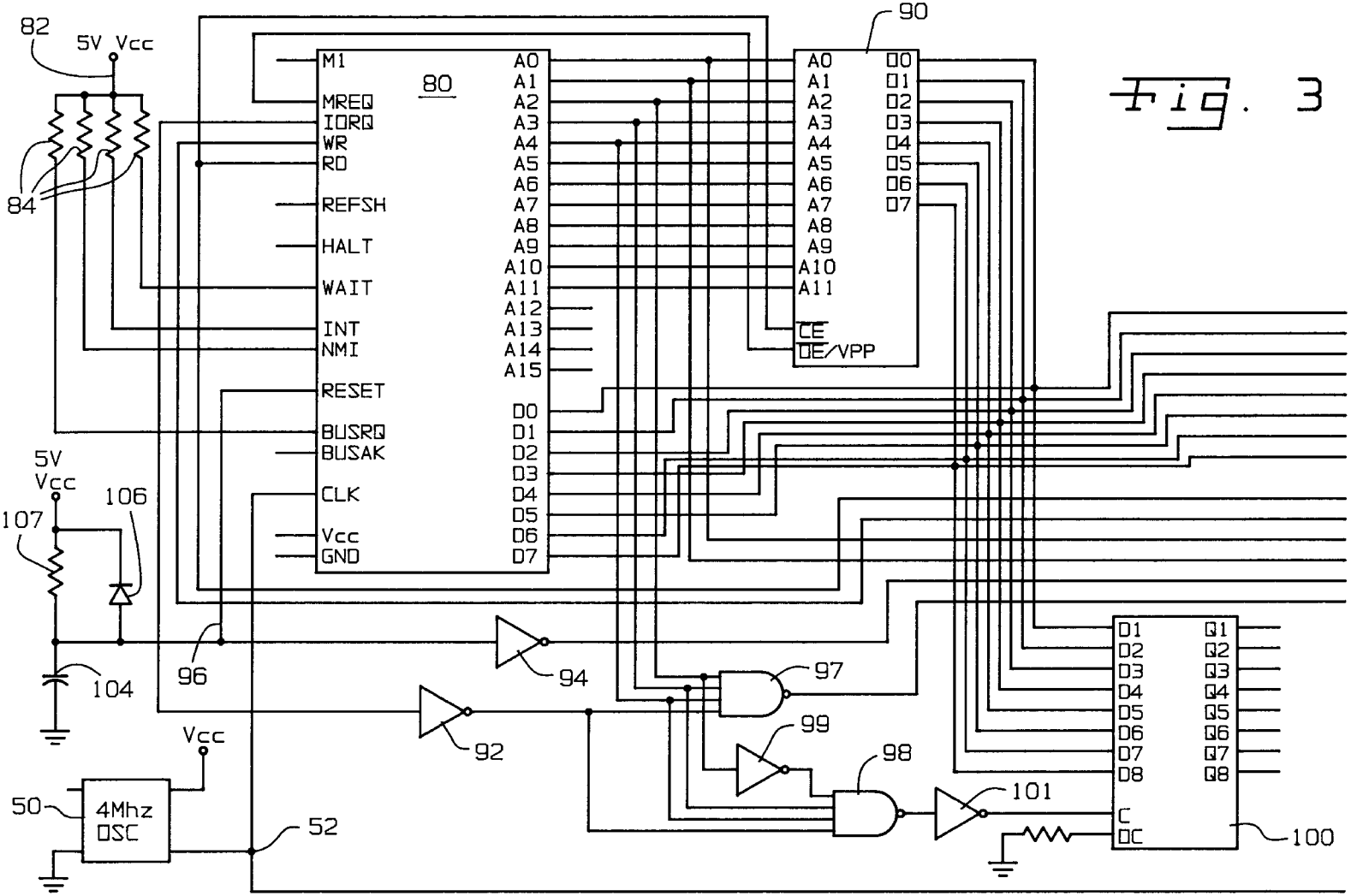
FIG. 3 is a schematic view of an embodiment of the microprocessor and memory circuit of the present invention.
Figure 4:
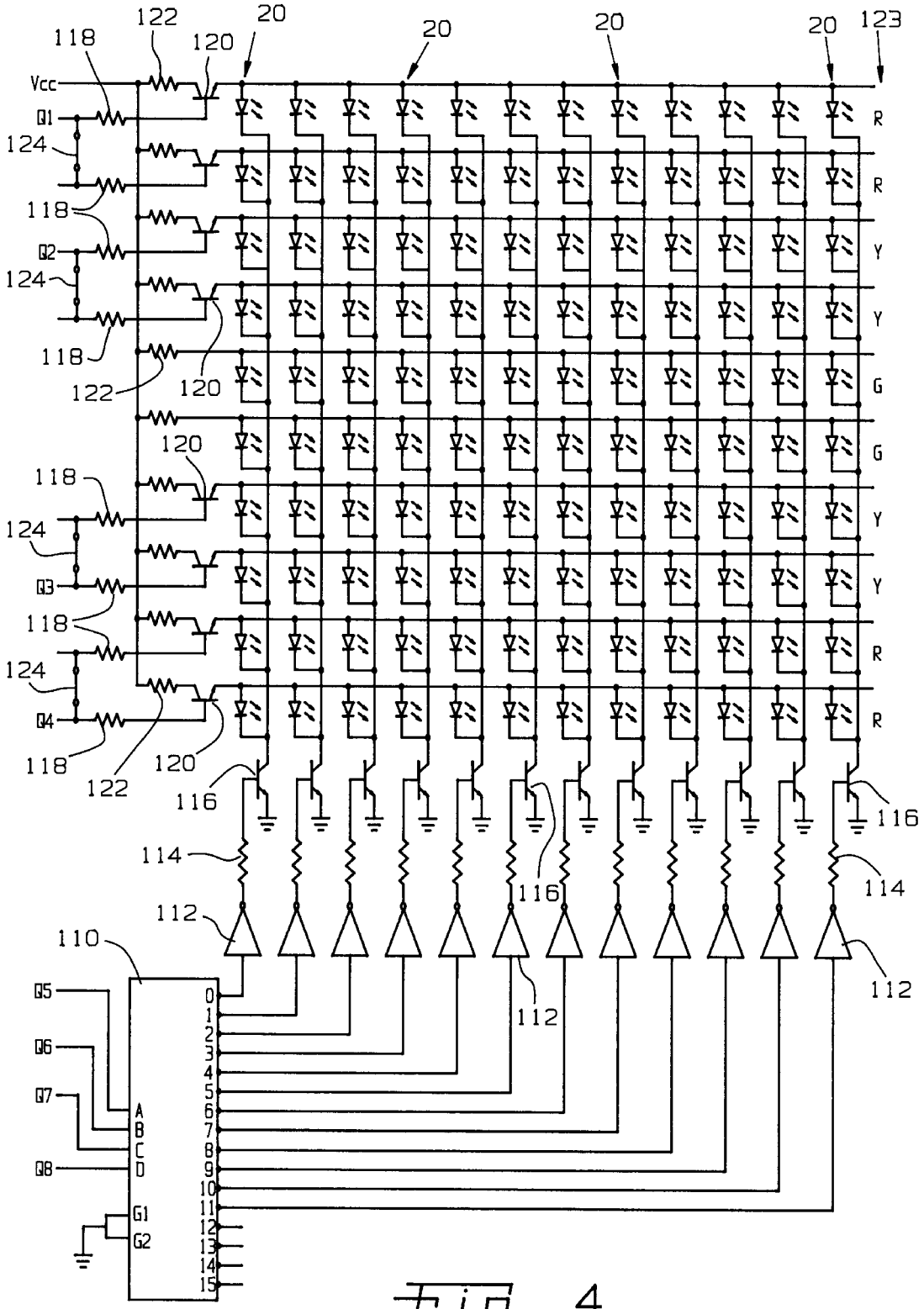
FIG. 4 is a schematic of an embodiment of the display sub-circuit of the present invention.

The schematic of device 10 as shown in FIGS. 2–4 will now be discussed with particular reference to the signal processing subbranch as shown in signal conditioning sub-circuit 22 (FIG. 2).

Input signal conditioning to a digital level, as utilized in the present invention, comprises three separate stages: 1) an input amplifier stage; 2) a noise eliminator stage; and 3) a digital level conditioning stage. The input amplifier stage sets the level of the input from a microphone or other vocal sound source and provides a high gain amplifier while also providing some input isolation to the circuit.

An input jack 24 takes the input signal from, for instance, a microphone or other suitable device such as a mixer, and passes it through an impedance matching device comprised of, in parallel, a resistor 25 of approximately 1 K ohms and a capacitor 26 of approximately 1 $\mu$F. The signal then passes through sensitivity potentiometer 14, having a resistance of approximately 10 K ohms used for selecting the sensitivity of device 10. The impedance is set to approximately 1000 ohms with the input level adjusted by sensitivity potentiometer 14. The signal then passes through additional isolation and control devices such as a capacitor 27 of approximately 1 $\mu$F connected in series with a 1 K ohm resistor 28.

The noise eliminator stage 35 (FIG. 2) of device 10 converts the signal input that is mostly a sine wave (the voice tone input) to that of a square wave signal. Device 10 has a trip point, i.e., the point at which the sine wave will produce a change of state of the square wave produced, which is approximately one-fourth volt above and below the zero crossover point of the sine wave input signal. Device 10 creates both a high gain amplifier and a Schmitt trigger to form the square wave that later is analyzed.

For purposes of explanation of the circuit of device 10, pin numbers are utilized to describe particular hookups to associated integrated circuits. Such pin numbers are not illustrated on the drawings for the sake of clarity.

A high gain OP amp is formed with integrated circuit (IC) chip 30. IC chip 30 may be a typical 741 OP amp available from SGS-Thomson of Phoenix, Ariz., although other OP amp IC chips may be utilized. Seven volts potential is applied to pin 7 of the chip while pin 3 is grounded through a resistor 32 of approximately 10 K ohms. The input signal from resistor 28 is ported both to pin 2 of IC chip 30 along with pin 6. Pins 1, 4 and 5 are connected to a negative 7 volt power source. Pins 2 and 6 of IC chip 30 are also connected together by a 10 M ohm resistor 34. Capacitors 26 and 27 provide for direct current isolation of input jack 24. The output is at approximately ±5 or ±6 volts.

The output from IC chip 30 is applied to IC chip 36. This IC chip 36 is also of the 741 family referred to above. IC chip 36 is utilized as a Schmitt trigger device which forms a positive feedback setup. By changing the value of resistor 40, adjustment of the trip point, i.e., the value at which the output signal flips to an opposite square wave level, is controlled.

In the present case, square wave function change is not accomplished at the zero crossing point of the original input signal, since generally there is a multitude of noise signals at that point, with additional harmonics even in the human voice. To eliminate that problem, the circuit is adjusted so that the square wave output is created on a ±0.25 volt swing of the input signal about the zero crossing point of the input sine wave. This is the trip point of the Schmitt trigger created by IC chip 36. In this way the circuit is able to: 1) block out background noise; and 2) eliminate the inherent fluctuations of a human voice at the zero crossing point of a vocal tone. The signal from IC chip 30 is applied to pin 2, while pin 3 is connected to a 100 K resistor 38 which is in electrical communication with pin 6. Also at that juncture, a 100 ohm resistor 40 is connected to ground. IC chip 36 is supplied with power at positive 7 volts to pin 7, while pins 1, 4 and 5 are connected to negative 7 volts.

The third stage of the input signal conditioning sub-circuit 22 corresponds to the digital level conditioning of the square wave created by the Schmitt trigger of IC chip 36. This conversion creates a TTL 5 volt logic compatible signal level which is then analyzed by the microprocessor 80 and counter sub-circuit counter IC chips 60 and 62.

At the junction of the output of pin 6 of IC chip 36 along with resistors 38 and 40 another resistor 42 of approximately 1 K ohms permits the signal to enter a base of a transistor such as a type 2N3904. Alternatively, other types of transistors may be utilized.

Transistor 44 has it's emitter connected to ground while the collector is attached to a positive 5 volt power source buffered with a resistor 46 of approximately 1 K ohms. Transistor 44 converts the ±5 or ±6 volt input signal to a TTL level, 5 volt digital signal. In the simplest manner, transistor 44 takes the ±5 or 6 volt signal from previously mentioned circuit components and converts it into a square wave from 0 to 5 volts. The collector line of transistor 44 is referenced as line 48.

A 4 mhz oscillator 50 (FIG. 3) is utilized to form the clock pulses for device 10 (FIG. 1). Oscillator 50 is powered by positive 5 volts and has a particular clock output line 52

(FIGS. 2 and 3) carrying clock pulses to microprocessor 80 (FIG. 3), and a divide by two (flip-flop) IC chip 54 (FIG. 2).

The square wave signal transposed by transistor 44 (FIG. 2.) is also applied to a divide by two integrated circuit chip such as IC chip 54, i.e., a flip flop. This divide by two IC chip is of the SN74LS76 family available from Motorola. The square wave signal from transistor 44 is applied to pin 1, while positive 5 volt power is applied through both pins 4 and 16 to JK portions respectively of the flip flop. Positive 5 volt power is also applied through a resistor 56 of approximately 470 ohms to pin 2. IC chip 54 takes the input signal of the square wave and divides it by two (2) so that the impulse on output (through line 57) follows one full cycle of the square wave input signal. This output is termed Q from IC chip 54, normally pin 15.

Clock pulses from line 52 along with the output of Q from IC chip 54 on line 57 are passed into an AND gate IC chip 58 of the 74HC08 type available from SGS-Thomson and other suppliers. AND gate IC chip 58 provides the gating of the input signal that will start and stop device 10, i.e., the counters which count one full input cycle of time relative to approximately 0.25 microseconds for each count.

The output of AND gate IC chip 58 is supplied to a 24 bit counter formed from two IC's chips 60 and 62 for instance of the 74HC4040 type available from SGS-Thomson. Other types of counter chips may also be utilized. The outputs Q1 through Q12 of the first IC chip 60 are utilized while only Q1 through Q5 are utilized on the second IC chip 62. In this way only 17 bits of the 24 bits of the counter combination are actually utilized, 16 of them used for data acquisition. The highest order bit, number 17, (port Q5 IC chip 62) is monitored through port PC0 of an I/O parallel port chip 64. This chip 64 is of the 8255 family available from Intel, although others may also be utilized.

As shown in FIG. 2, reset lines (RS7) of both IC chip 60 and 62 are connected together and connected to the PC6 port of I/O parallel port chip 64. The reset line of both IC counter chips 60 and 62 are further connected to an inverter IC chip 66 of the 74HC04 type available from SGS-Thomson. The same type of inverter IC chip is utilized in other portions of the circuit herein described when an inverter IC chip is needed. IC chip 66 inverts the reset signal and applies that signal to the "clear" load pin, pin 3 of divide by two IC chip 54. This permits counter IC chips 60 and 62 of device 10 to be cleared and the operational state of divide by two IC chip 54 restarted when needed or desired.

I/O parallel port chip 64 (FIG. 2.) includes a data port PA and PB. This allows I/O parallel port IC chip 64 to accept the square wave count from the counter IC chips 60 and 62. A port C on chip 64 is used to start the counter reset, divide by two IC chip 54 into their initial state, in addition to monitoring line Q-not (lead line 68) applied to PC1. I/O parallel port chip 64 tests for data overflow in addition to reading the square wave count from the counting IC chips 60 and 62.

Additionally, I/O parallel port IC chip 64 has outputs to turn ON the counting and reset the clock and flip flop IC (IC chip 54) as shown by port PC6 having a line 70 connected to inverter IC 66. An output line PC7 is connected through an AND gate IC chip 72 in which output line PC7 is ANDed with clock input line 52 whose result is an input to AND gate IC chip 58. AND gate IC chip 72 is of the same type as AND gate IC chip 58.

The data lines from I/O parallel port chip 64 and the address and control lines are tied directly to microprocessor chip 80 through the read-write lines D0 through D7 tied directly to respective D0 through D7 data ports of microprocessor 80.

Microprocessor chip 80 (FIG. 3) of device 10 is that of a Z80A (Z0840004) microprocessor, 4 mhz CPU available from Zilog, Inc. Microprocessor 80 utilizes rapid instruction execution with subsequent high data throughput. Power for microprocessor chip 80 comes through a positive 5 volt line 82 which is buffered with four, 2K ohm resistors 84 and applied in parallel to the wait control, interrupt request control, non-maskable interrupt control, and bus request line control lines of microprocessor 80.

Microprocessor 80 is connected via address bus lines A0 through All to an EPROM chip 90. This EPROM chip 90 contains read only memory including the program and data display look up information as set forth herein below in the section entitled "Program". EPROM chip 90 is typically that of a 2732 family (MZ732A-2F1) IC Chip available from SGS-Thomson, although others may be utilized. As shown EPROM chip 90 address lines A0 through A11 are tied in one-to-one correspondence with microprocessor 80 address lines A0 through A11. The output lines (00–07) of EPROM 90 are attached in order to the DO through D7 data bus lines of I/O parallel port chip 64 and the DO through D7 data bus lines of microprocessor 80.

More importantly, output lines 00 through 07 are connected to the data ports D1 through D8 respectively of latch IC 100. This latch IC 100 additionally has output lines Q1 through Q8.

Each physical device attached to the data lines of microprocessor 80 needs to have an input/output address that microprocessor 80 can access. The addresses of I/O parallel port chip 64 and latch IC 100 are set by the following circuitry. An inverter IC chip 92 is connected to the I/O Request line (IORQ) of microprocessor 80. A separate inverter IC chip 94 is connected to the reset line 96 of microprocessor 80. Each of these IC chips 92 and 94 are of the same type as inverter IC chip 66.

Inverter IC chip 94 is further connected to the reset of I/O parallel port chip 64. Selection of either I/O parallel port chip 64 or latch IC chip 100 for a destination of data is through a four input NAND gate IC chip 97 having an input connected to inverter chip 92. The other three inputs to NAND gate IC chip 97 are connected to address lines A2 through A4 of microprocessor 80. The A0 and A1 lines of microprocessor 80 are respectively connected to the A0 and A1 lines of I/O parallel port chip 64. The output of NAND gate IC chip 97 is connected to the chip select active low (CS Not) line of I/O parallel port chip 64.

A separate four input NAND gate IC chip 98 is utilized for developing the decode logic for latch IC chip 100. The inputs to NAND gate IC chip 98 include the output from inverter IC chip 92, lines A3 and A4 of microprocessor 80, and inverse of line A2 created by an inverter IC chip 99 electrically connected between the A2 line of microprocessor 80 and NAND gate IC chip 98. The output of NAND gate IC chip 98 is then passed through an inverter IC chip 101 and then connected to the "Clear" pin of latch IC chip 100. Together inverter IC chips 92, 94 and 99 along with NAND gate IC chips 97 and 98 combine to form the decode logic for the I/O addresses of the latch IC chip 100 and I/O parallel port chip 64.

A power on reset branch circuit to reset microprocessor 80 and I/O parallel port chip 64 utilizes a 15 K ohm resistor 102 having one lead connected to positive five volts power and another lead in series with a 100 $\mu$F capacitor 104 connected to ground. A diode 106 such as a 1N914 is connected between the positive five volt power and the junction of resistor 102 and capacitor 104. Diode 106 prohibits current flow from the power source to the junction of resistor 102 and capacitor 104. The junction of resistor 102 and capacitor 104 is connected to reset line 96 and inverter 94.

As previously described, the indicator bank 16 (FIG. 1) consists of twelve columns 20 of ten light emitting diodes 18. The higher order nibble of each data element found in EPROM chip 90 and latched into latch IC chip 100 is decoded by microprocessor 80 on the display circuit to find the column 20 representing the particular note of the data representation. The low order nibble of the data (Program lines 170 through 268 below) control how many of LEDs 18 are lit for each column 20.

As shown in FIG. 4, driver IC chip 110 is utilized to de-multiplex the signal formed from the output of latch IC chip 100. The multiplex signal is inputted through lines Q5 through Q8. The signal is de-multiplexed through driver IC chip 110 to output lines, Ports 0 through 11. Ports 12 through 15 on driver IC chip 110 are not used, while ports G1 and G2 are grounded. Driver IC chip 110 comprises a 74LS154 type IC chip available from SGS-Thomson, although other types of drivers may be utilized. Each output from chip 110 is passed through an inverter 112 comprised of a S993E9514 type available also from SGS-Thomson to invert the signal (FIG. 4). The signal so inverted is passed through a resistor 114 which has a resistance of approximately 470 ohms. The signal then passes to the base of a transistor 116. Transistor 116 is of the general type to which the emitter is grounded and the collector is connected to the power leads of a column 20 of LEDs 18.

The outputs from latch IC chip 100, Q1, Q2, Q3 and Q4, are buffered by resistors 118 of approximately 470 ohms. Each of these resistors 118 are connected to the base of a transistor 120 of the NPN type which are connected in sequence to the rows of LEDs 18. The collectors of transistors 120 are connected in parallel with the VCC source power at positive five volts power, buffered through a resistor 122 having a rating of approximately 150 ohms. Each of the display transistors 120 is of the standard 2N2222 type, commercially available, although others may be similarly utilized. As shown in FIG. 4, the input lines Q1, Q2, Q3 and Q4 are split with a jumper 124. These jumpers permit later expansion and an increase in the precision available for the display of the voice data.

As shown in FIG. 4, if a single column 20 is selected by an output of driver IC chip 110, the central green LEDs 18 (G) will be illuminated signaling that the input voice data was on pitch. If such a column is lit with the addition of input from either Q2 or Q3, the yellow LEDs 18 (Y) are respectively illuminated signalling that the voice input data is, for instance, ±10 percent away from the perfect pitch indicated by that particular column 20. If a column is lit with input from either Q1 or Q4, red LEDs 18 (R) will be illuminated, indicating that the voice input data is, for example, ±20 percent away from the perfect note assigned to that column 20.

The letters G. Y, and R indicated by reference line 123 signify the visible color of each particular row of LEDs 18. The letter G stands for the color green, while Y stands for the color yellow and R stands for the color red. This color scheme correlated with the particular columns 20 of LEDs 18 permit an intuitive display of information back to a singer or sound person trying to determine the chromatic pitch of the originally input note.

Figure 5:
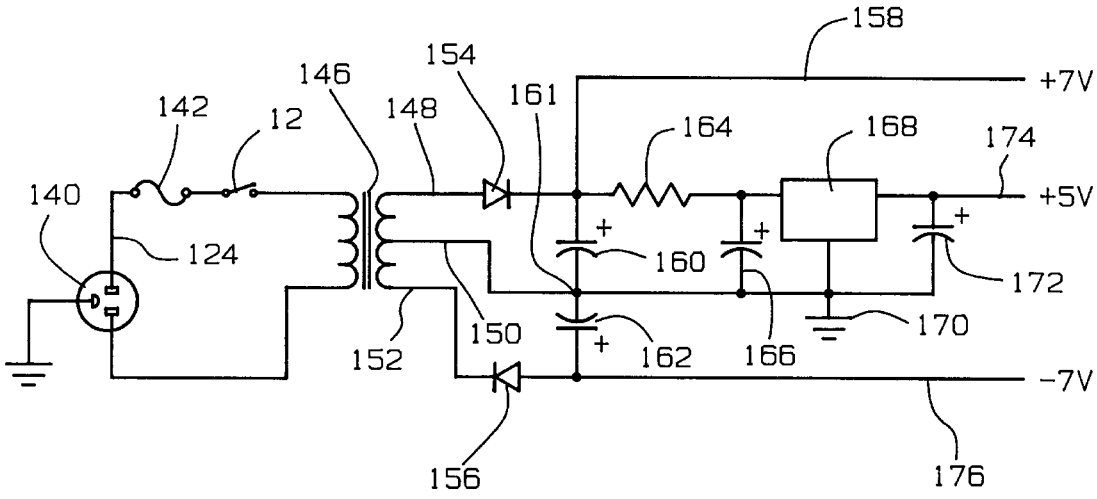
FIG. 5 is a schematic view of an embodiment of the power unit of the present invention.

The power sub-circuit for device 10 is shown in FIG. 5, in which AC power is supplied through a plug 140 having a hot lead 142 pass through a fuse 142 having a rating of approximately 0.5 ampere, connected to ON/OFF switch 12. ON/OFF switch 12 is of the single throw switch variety. Switch 12 is connected to one input lead pole of the primary of an iron core transformer 146, the other lead of the primary is connected to the neutral line of plug 140.

As shown in FIG. 5, transformer 146 is that of a 12.6 VAC split secondary transformer including a secondary with a top lead 148, a center tap lead 150 and a bottom lead 152. A diode 154 is in series with top lead 148 in electrical communication with line 158 having a potential of approximately positive seven volts. A cross over capacitor 160, having a rating of approximately 4700 $\mu$F and 16 volts, connects line 158 to that of center tap lead 150, i.e., at connection point 161. Near the above connection point 161, another cross over capacitor 162, having the same rating, connects between the center tap lead 150 and a diode 156. Diode 156 connects back to bottom lead 152. Diodes 154 and 156 are connected as shown and are of the 1N4004 family, although other types may be utilized. Diode 156 and bottom lead 152 are at a potential of approximately negative seven volts.

The positive five volts power supply is created between top lead 148 and center tap lead 150 with a power IC chip 168 of the LM7805 family available from New Japan Radio of Tokyo, Japan, although others may be utilized. A 1 ohms resistor 164 connects the voltage in top lead 148 with power IC chip 168. Between resistor 164 and power IC chip 168 is connected a crossover capacitor 166 that connects with center tap lead 150. Crossover capacitor 166 has a rating of 1000 $\mu$F and a6 volts. The ground pin of power IC chip 168 connects with center tap lead 150 and with an electrical ground 170. The voltage out lead of power IC chip 168 connects to line 174 which is at a potential of positive five volts. A cross over capacitor 172 connects between line 174 and both center tap lead 150 and electrical ground 170.

Below is a listing of an embodiment of a program for use with the above referenced components and microprocessor 80. Such a program is stored in EPROM chip 90 using conventional methods.

Program

```
0001   0000          .ORG 0000H
0002   0000          ; DISPLAY ALL LIGHTS ON
0003   0000 01 FF 3F LD BC,3FFFH
0004   0003 3E 0F    LOOP1   LD A,0FH
0005   0005 D3 18    OUT (18H),A
```

```
0006   0007 00        NOP
0007   0008 00        NOP
0008   0009 3E 1F     LD A,1FH
0009   000B D3 18     OUT (18H),A
0010   000D 00        NOP
0011   000E 00        NOP
0012   000F 3E 2F     LD A,2FH
0013   0011 D3 18     OUT (18H),A
0014   0013 00        NOP
0015   0014 00        NOP
0016   0015 3E 3F     LD A,3FH
0017   0017 D3 18     OUT (18H),A
0018   0019 00        NOP
0019   001A 00        NOP
0020   001B 3E 4F     LD A,4FH
0021   001D D3 18     OUT (18H),A
0022   001F 00        NOP
0023   0020 00        NOP
0024   0021 3E 5F     LD A,5FH
0025   0023 D3 18     OUT (18H),A
0026   0025 00        NOP
0027   0026 00        NOP
0028   0027 3E 6F     LD A,6FH
0029   0029 D3 18     OUT (18H),A
0030   002B 00        NOP
0031   002C 00        NOP
0032   002D 3E 7F     LD A,7FH
0033   002F D3 18     OUT (18H),A
0034   0031 00        NOP
0035   0032 00        NOP
0036   0033 3E 8F     LD A,8FH
0037   0035 D3 18     OUT (18H),A
0038   0037 00        NOP
0039   0038 00        NOP
0040   0039 3E 9F     LD A,9FH
0041   003B D3 18     OUT (18H),A
0042   003D 00        NOP
0043   003E 00        NOP
0044   003F 3E AF     LD A,0AFH
0045   0041 D3 18     OUT (18H),A
0046   0043 00        NOP
0047   0044 00        NOP
0048   0045 3E BF     LD A,0BFH
0049   0047 D3 18     OUT (18H),A
0050   0049 00        NOP
0051   004A 00        NOP
0052   004B 0B        DEC BC
0053   004C 79        LD A,C
0054   004D E6 FF     AND 0FFH
0055   004F 20 B2     JR NZ,LOOP1
0056   0051 78        LD A,B
0057   0052 E6 FF     AND 0FFH
0058   0054 20 AD     JR NZ,LOOP1
0059   0056
0060   0056 3E D0     LD A,0D0H
0061   0058 D3 18     OUT (18H),A  :TURN OFF ALL LIGHTS ON DISPLAY
0062   005A
0063   005A           ;BEGIN SAMPLING OF INPUTS FOR THE FIRST TIME
0064   005A 06 1F     LD B,01FH
0065   005C 3E 93     PGM     LD A,93H        ;INITIALIZE 8255 I/O
0066   005E D3 1F     OUT (1FH),A
0067   0060 10 FA     DJNZ PGM
0068   0062 06 1F     LD B,01FH
0069   0064 00        DELAY   NOP
```

```
0065 10 FD    DJNZ DELAY
0067
0067 3E 40    RESET   LD A,40H          ;CLEAR INPUT FLIP FLOP
                                        AND RESET COUNTERS TO ZERO
0069 D3 1E    OUT (1EH),A
006B 3E 20    LD A,20H      ;TURN ON BIT 5 FOR STATUS FLAG LED
006D D3 1E    OUT (1EH),A
006F
006F DB 1E    TESTQ   IN A,(1EH)   ;IS Q-NOT ON 7476 HIGH?
0071 CB 4F    BIT 1,A
0073 28 FA    JR Z,TESTQ       ;IF ZERO TEST Q-NOT AGAIN
0075
0075 3E 80    LD A,80H
0077 D3 1E    OUT (1EH),A      ;BEGIN COUNTERS AND
0079 DB 1E    TESTQ2  IN A,(1EH)   ;WAIT FOR Q-NOT TO GO TO ZERO
007B CB 4F    BIT 1,A
007D 20 FA    JR NZ,TESTQ2
007F DB 1E    TESTQ3  IN A,(1EH)       ;WHILE Q-NOT IS ZERO
                                        COUNTERS ARE RUNNING
0081 CB 47    BIT 0,A          ;TEST FOR COUNTER OVERFLOW
0083 20 E2    JR NZ,RESET
0085
0085 CB 4F    BIT 1,A          ;KEEP COUNTER RUNNING ONE
                                        FULL INPUT CYCLE
0087 28 F6    JR Z,TESTQ3      ;UNTIL Q-NOT IS HIGH
0089
0089 3E 00    LD A,00H         ;TURN OFF COUNTERS
008B D3 1E    OUT (1EH),A
008D
008D DB 1D    IN A,(1DH)       ;INPUT RAW FREQUENCY DATA
                                        INTO REGISTER DE
008F 57       LD D,A
0090 DB 1C    IN A,(1CH)
0092 5F       LD E,A
0093
0093          ;IS DE>0300H OR 768
0093 7A       LD A,D
0094 FE 03    CP 03H
0096 38 CF    JR C,RESET       ;IF CARRY THEN HL<0300H AND
                                        NEED TO RESAMPLE INPUT
0098
0098 3E 40   SECOND  LD A,40H         ;CLEAR INPUT FLIP FLOP
                                        AND RESET COUNTERS
009A D3 1E    OUT (1EH),A
009C 3E 20    LD A,20H
009E D3 1E    OUT (1EH),A
00A0 DB 1E    TESTQX  IN A,(1EH)
00A2 CB 4F    BIT 1,A
00A4 28 FA    JR Z,TESTQX
00A6 3E 80    LD A,80H
00A8 D3 1E    OUT (1EH),A
00AA
00AA DB 1E    TESTQ2X IN A,(1EH)
00AC CB 4F    BIT 1,A
00AE 20 FA    JR NZ,TESTQ2X
00B0 DB 1E    TESTQ3X IN A,(1EH)
00B2 CB 47    BIT 0,A
00B4 20 E2    JR NZ,SECOND
00B6 CB 4F    BIT 1,A
00B8 28 F6    JR Z,TESTQ3X
00BA 3E 00    LD A,00H
00BC D3 1E    OUT (1EH),A
00BE DB 1D    IN A,(1DH)
00C0 67       LD H,A
```

```
00C1 DB 1C     IN A,(1CH)
00C3 6F        LD L,A
00C4
00C4           ;IS HL>0300H OR 768
00C4 7C        LD A,H
00C5 FE 03     CP 03H
00C7 38 CF     JR C,SECOND
00C9
00C9           ;COMPARE FIRST RAW VALUE IN DE WITH SECOND
                  RAW VALUE IN HL
00C9 BA        CP D
00CA 20 9B     JR NZ,RESET      ;START OVER IF HIGH ORDER
                                   BYTE IS NOT THE SAME
00CC
00CC           ;AVERAGE THE LOW ORDER BYTES TOGETHER
00CC CB 3D     SRL L
00CE CB 3B     SRL E
00D0 7B        LD A,E
00D1 85        ADD A,L
00D2 6F        LD L,A
00D3
00D3           ;IS HL<07FFH OR 2047
00D3 7C        LOOP4X  LD A,H
00D4 FE 07     CP 07H
00D6 28 10     JR Z,OUTPUT
00D8 38 0E     JR C,OUTPUT
00DA
00DA           ;DIVIDE VALUE OF HL BY TWO
00DA CB 3C     DIVIDEX SRL H
00DC 38 04     JR C,SET7LX
00DE CB 3D     SRL L
00E0 18 04     JR DDONEX
00E2 CB 3D     SET7LX  SRL L
00E4 CB FD     SET 7,L
00E6 18 EB     DDONEX  JR LOOP4X
00E8
00E8           ;TRANSLATE NOTE DATA FROM DISPLAY TABLE
00E8 7E           OUTPUT  LD A,(HL)
00E9
00E9           ;OUTPUT DATA TO THE DISPLAY
00E9 D3 18     OUT (18H),A
00EB C3 67 00 JP RESET        ;SAMPLE AGAIN
00EE
0300           .ORG 0300H
0300 42 42 42 42  .BYTE 42H,42H,42H,42H
0304 434343434343 .BYTE 43H,43H,43H,43H,43H,43H,43H,43H,43H
                                                        ;19.5%
030A 434343
030D 3C3C3C3C3C3C .BYTE 3CH,3CH,3CH,3CH,3CH,3CH,3CH,3CH,3CH
                                                        ;19.5%
0313 3C3C3C
0316 343434343434 .BYTE 34H,34H,34H,34H,34H,34H,34H,34H
                                                        ;17.3%
031C 3434
031E 303030303030 .BYTE 30H,30H,30H,30H,30H,30H,30H,30H,30H,30H
                                                        ;21.7%
0324 30303030
0328 323232323232 .BYTE 32H,32H,32H,32H,32H,32H,32H,32H,32H
                                                        ;19.5%
032E 323232
0331 333333333333 .BYTE 33H,33H,33H,33H,33H,33H,33H,33H,33H,33H
                                                        ;21.7%
0337 33333333
```

```
0177   033B 2C2C2C2C2C2C .BYTE 2CH,2CH,2CH,2CH,2CH,2CH,2CH,2CH,2CH,2CH
                                                                  ;20%
0177   0341 2C2C2C2C
0178   0345 242424242424 .BYTE 24H,24H,24H,24H,24H,24H,24H,24H,24H
                                                                  ;18%
0178   034B 242424
0179   034E 202020202020 .BYTE 20H,20H,20H,20H,20H,20H,20H,20H,20H,20H
                                                                  ;20%
0179   0354 20202020
0180   0358 222222222222 .BYTE 22H,22H,22H,22H,22H,22H,22H,22H,22H,22H
                                                                  ;20%
0180   035E 22222222
0181   0362 232323232323.BYTE 23H,23H,23H,23H,23H,23H,23H,23H,
                              23H,23H,23H                         ;22%
0181   0368 2323232323
0182   036D 1C1C1C1C1C1C .BYTE 1CH,1CH,1CH,1CH,1CH,1CH,1CH,1CH,1CH,1CH
                                                                  ;19.6%
0182   0373 1C1C1C1C
0183   0377 141414141414 .BYTE 14H,14H,14H,14H,14H,14H,14H,14H,14H,14H
                                                                  ;19.6%
0183   037D 14141414
0184   0381 101010101010 .BYTE 10H,10H,10H,10H,10H,10H,10H,10H,
                              10H,10H,10H                         ;21.6%
0184   0387 1010101010
0185   038C 121212121212 .BYTE 12H,12H,12H,12H,12H,12H,12H,12H,12H,12H
                                                                  ;19.6%
0185   0392 12121212
0186   0396 131313131313 .BYTE 13H,13H,13H,13H,13H,13H,13H,13H,13H,13H
                                                                  ;19.6%
0186   039C 13131313
0187   03A0 0C0C0C0C0C0C .BYTE 0CH,0CH,0CH,0CH,0CH,0CH,0CH,0CH,0CH,0CH
                                                                  ;17.9%
0187   03A6 0C0C0C0C
0188   03AA 040404040404 .BYTE 04H,04H,04H,04H,04H,04H,04H,04H,
                              04H,04H,04H                         ;19.6%
0188   03B0 0404040404
0189   03B5 000000000000 .BYTE 00H,00H,00H,00H,00H,00H,00H,00H,00H,
                              00H,00H,00H                         ;21.4%
0189   03BB 000000000000
0190   03C1 020202020202 .BYTE 02H,02H,02H,02H,02H,02H,02H,02H,02H,
                              02H,02H,02H                         ;21.4%
0190   03C7 020202020202
0191   03CD 030303030303 .BYTE 03H,03H,03H,03H,03H,03H,03H,03H,
                              03H,03H,03H                         ;19.6%
0191   03D3 0303030303
0192   03D8 BCBCBCBCBCBC .BYTE 0BCH,0BCH,0BCH,0BCH,0BCH,0BCH,0BCH,
                              0BCH,0BCH,0BCH,0BCH                 ;18.6%
0192   03DE BCBCBCBCBC
0193   03E3 B4B4B4B4B4B4 .BYTE 0B4H,0B4H,0B4H,0B4H,0B4H,0B4H,0B4H,
                              0B4H,0B4H,0B4H,0B4H,0B4H            ;20.3%
0193   03E9 B4B4B4B4B4B4
0194   03EF B0B0B0B0B0B0 .BYTE 0B0H,0B0H,0B0H,0B0H,0B0H,0B0H,0B0H,
                              0B0H,0B0H,0B0H,0B0H,0B0H            ;20.3%
0194   03F5 B0B0B0B0B0B0
0195   03FB B2B2B2B2B2B2 .BYTE 0B2H,0B2H,0B2H,0B2H,0B2H,0B2H,0B2H,
                              0B2H,0B2H,0B2H,0B2H,0B2H            ;20.3%
0195   0401 B2B2B2B2B2B2
0196   0407 B3B3B3B3B3B3 .BYTE 0B3H,0B3H,0B3H,0B3H,0B3H,0B3H,0B3H,
                              0B3H,0B3H,0B3H,0B3H,0B3H            ;20.3%
0196   040D B3B3B3B3B3B3
0197   0413 ACACACACACAC .BYTE 0ACH,0ACH,0ACH,0ACH,0ACH,0ACH,0ACH,
                              0ACH,0ACH,0ACH,0ACH,0ACH            ;19.4%
0197   0419 ACACACACACAC
0198   041F A4A4A4A4A4A4 .BYTE 0A4H,0A4H,0A4H,0A4H,0A4H,0A4H,0A4H,
```

```
                                0A4H,0A4H,0A4H,0A4H,0A4H      ;19.4%
0198   0425 A4A4A4A4A4A4
0199   042B A0A0A0A0A0A0 .BYTE 0A0H,0A0H,0A0H,0A0H,0A0H,0A0H,0A0H,
                                0A0H,0A0H,0A0H,0A0H,0A0H,0A0H       ;21%
0199   0431 A0A0A0A0A0A0A0
0200   0438 A2A2A2A2A2A2 .BYTE 0A2H,0A2H,0A2H,0A2H,0A2H,0A2H,0A2H,
                                0A2H,0A2H,0A2H,0A2H,0A2H      ;19.4%
0200   043E A2A2A2A2A2A2
0201   0444 A3A3A3A3A3A3 .BYTE 0A3H,0A3H,0A3H,0A3H,0A3H,0A3H,0A3H,
                                0A3H,0A3H,0A3H,0A3H,0A3H      ;19.4%
0201   044A A3A3A3A3A3A3
0202   0450 9C9C9C9C9C9C .BYTE 9CH,9CH,9CH,9CH,9CH,9CH,9CH,9CH,
                                9CH,9CH,9CH,9CH,9CH        ;20%
0202   0456 9C9C9C9C9C9C9C
0203   045D 949494949494 .BYTE 94H,94H,94H,94H,94H,94H,94H,94H,
                                94H,94H,94H,94H,94H        ;20%
0203   0463 94949494949494
0204   046A 909090909090 .BYTE 90H,90H,90H,90H,90H,90H,90H,90H,
                                90H,90H,90H,90H,90H        ;20%
0204   0470 90909090909090
0205   0477 929292929292 .BYTE 92H,92H,92H,92H,92H,92H,92H,92H,
                                92H,92H,92H,92H,92H        ;20%
0205   047D 92929292929292
0206   0484 939393939393 .BYTE 93H,93H,93H,93H,93H,93H,93H,93H,
                                93H,93H,93H,93H,93H        ;20%
0206   048A 93939393939393
0207   0491 8C8C8C8C8C8C .BYTE 8CH,8CH,8CH,8CH,8CH,8CH,8CH,8CH,
                                8CH,8CH,8CH,8CH,8CH,8CH    ;20%
0207   0497 8C8C8C8C8C8C8C8C
0208   049F 848484848484 .BYTE 84H,84H,84H,84H,84H,84H,84H,84H,
                                84H,84H,84H,84H,84H,84H    ;20%
0208   04A5 8484848484848484
0209   04AD 808080808080 .BYTE 80H,80H,80H,80H,80H,80H,80H,80H,
                                80H,80H,80H,80H,80H,80H    ;20%
0209   04B3 8080808080808080
0210   04BB 828282828282 .BYTE 82H,82H,82H,82H,82H,82H,82H,82H,
                                82H,82H,82H,82H,82H,82H    ;20%
0210   04C1 8282828282828282
0211   04C9 838383838383 .BYTE 83H,83H,83H,83H,83H,83H,83H,83H,
                                83H,83H,83H,83H,83H,83H    ;20%
0211   04CF 8383838383838383
0212   04D7 7C7C7C7C7C7C .BYTE 7CH,7CH,7CH,7CH,7CH,7CH,7CH,7CH,
                                7CH,7CH,7CH,7CH,7CH,7CH,7CH    ;20.5%
0212   04DD 7C7C7C7C7C7C7C7C7C
0213   04E6 747474747474 .BYTE 74H,74H,74H,74H,74H,74H,74H,74H,
                                74H,74H,74H,74H,74H,74H        ;19.1%
0213   04EC 7474747474747474
0214   04F4 707070707070 .BYTE 70H,70H,70H,70H,70H,70H,70H,70H,
                                70H,70H,70H,70H,70H,70H,70H    ;20.5%
0214   04FA 7070707070707070
0215   0503 727272727272 .BYTE 72H,72H,72H,72H,72H,72H,72H,72H,
                                72H,72H,72H,72H,72H,72H        ;19.1%
0215   0509 7272727272727272
0216   0511 737373737373 .BYTE 73H,73H,73H,73H,73H,73H,73H,73H,
                                73H,73H,73H,73H,73H,73H,73H    ;20.5%
0216   0517 7373737373737373
0217   0520 6C6C6C6C6C6C .BYTE 6CH,6CH,6CH,6CH,6CH,6CH,6CH,6CH,
                                6CH,6CH,6CH,6CH,6CH,6CH,6CH       ;19%
0217   0526 6C6C6C6C6C6C6C6C6C
0218   052F 646464646464 .BYTE 64H,64H,64H,64H,64H,64H,64H,64H,
                                64H,64H,64H,64H,64H,64H,64H,64H   ;20.2%
0218   0535 6464646464646464646464
0219   053F 606060606060 .BYTE 60H,60H,60H,60H,60H,60H,60H,60H,
                                60H,60H,60H,60H,60H,60H,60H,60H   ;20.2%
```

```
0219   0545 60606060606060606060
0220   054F 626262626262 .BYTE 62H,62H,62H,62H,62H,62H,62H,62H,
                                62H,62H,62H,62H,62H,62H,62H,62H  ;20.2%
0220   0555 62626262626262626262
0221   055F 636363636363 .BYTE 63H,63H,63H,63H,63H,63H,63H,63H,
                                63H,63H,63H,63H,63H,63H,63H,63H  ;20.2%
0221   0565 63636363636363636363
0222   056F 5C5C5C5C5C5C .BYTE 5CH,5CH,5CH,5CH,5CH,5CH,5CH,5CH,
                                5CH,5CH,5CH,5CH,5CH,5CH,5CH,5CH  ;19.2%
0222   0575 5C5C5C5C5C5C5C5C5C5C
0223   057F 545454545454 .BYTE 54H,54H,54H,54H,54H,54H,54H,54H,
                                54H,54H,54H,54H,54H,54H,54H,54H  ;19.2%
0223   0585 54545454545454545454
0224   058F 505050505050 .BYTE 50H,50H,50H,50H,50H,50H,50H,50H,
                                50H,50H,50H,50H,50H,50H,50H,50H,50H
                                                                 ;20.4%
0224   0595 50505050505050505050
0225   05A0 525252525252 .BYTE 52H,52H,52H,52H,52H,52H,52H,52H,
                                52H, 52H,52H,52H,52H,52H,52H,52H,52H
                                                                 ;20.4%
0225   05A6 52525252525252525252
0226   05B1 535353535353 .BYTE 53H,53H,53H,53H,53H,53H,53H,53H,
                                53H,53H,53H,53H,53H,53H,53H,53H,53H
                                                                 ;20.4%
0226   05B7 53535353535353535353
0227   05C2 4C4C4C4C4C4C .BYTE 4CH,4CH,4CH,4CH,4CH,4CH,4CH,4CH,
                           4CH,4CH,4CH,4CH,4CH,4CH,4CH,4CH,4CH,4CH
                                                                 ;20.6%
0227   05C8 4C4C4C4C4C4C4C4C4C4C4C
0228   05D4 444444444444 .BYTE 44H,44H,44H,44H,44H,44H,44H,44H,
                           44H,44H,44H,44H,44H,44H,44H,44H,44H
                                                                 ;19.5%
0228   05DA 44444444444444444444
0229   05E5 404040404040 .BYTE 40H,40H,40H,40H,40H,40H,40H,40H,
                           40H,40H,40H,40H,40H,40H,40H,40H,40H
                                                                 ;19.5%
0229   05EB 40404040404040404040
0230   05F6 424242424242 .BYTE 42H,42H,42H,42H,42H,42H,42H,42H,
                           42H,42H,42H,42H,42H,42H,42H,42H,42H
                                                                 ;19.5%
0230   05FC 42424242424242424242
0231   0607 434343434343 .BYTE 43H,43H,43H,43H,43H,43H,43H,43H,
                           43H,43H,43H,43H,43H,43H,43H,43H,43H,43H
                                                                 ;20.6%
0231   060D 43434343434343434343434343
0232   0619 3C3C3C3C3C3C .BYTE 3CH,3CH,3CH,3CH,3CH,3CH,3CH,3CH,
                           3CH,3CH,3CH,3CH,3CH,3CH,3CH,3CH,3CH,3CH
                                                                 ;19.5%
0232   061F 3C3C3C3C3C3C3C3C3C3C3C3C
0233   062B 343434343434 .BYTE 34H,34H,34H,34H,34H,34H,34H,34H,
                           34H,34H,34H,34H,34H,34H,34H,34H,34H,34H,34H
                                                                 ;20.6%
0233   0631 34343434343434343434343434
0234   063E 303030303030 .BYTE 30H,30H,30H,30H,30H,30H,30H,30H,
                           30H,30H,30H,30H,30H,30H,30H,30H,30H,30H
                                                                 ;19.5%
0234   0644 30303030303030303030303030
0235   0650 323232323232 .BYTE 32H,32H,32H,32H,32H,32H,32H,32H,
                           32H,32H,32H,32H,32H,32H,32H,32H,32H,32H,32H
                                                                 ;20.6%
0235   0656 32323232323232323232323232
0236   0663 333333333333 .BYTE 33H,33H,33H,33H,33H,33H,33H,33H,
                           33H,33H,33H,33H,33H,33H,33H,33H,33H,33H
                                                                 ;19.5%
```

```
0236   0669 333333333333333333333333
0237   0675 2C2C2C2C2C2C .BYTE 2CH,2CH,2CH,2CH,2CH,2CH,2CH,2CH,
                         2CH,2CH,2CH,2CH,2CH,2CH,2CH,2CH,2CH,2CH,2CH
0237   067B 2C2C2C2C2C2C2C2C2C2C2C2C2C
0238   0688 242424242424 .BYTE 24H,24H,24H,24H,24H,24H,24H,24H,
                    24H,24H,24H,24H,24H,24H,24H,24H,24H,24H,24H,24H
0238   068E 24242424242424242424242424
0239   069C 202020202020 .BYTE 20H,20H,20H,20H,20H,20H,20H,20H,20H,
                    20H,20H,20H,20H,20H,20H,20H,20H,20H,20H,20H,20H
0239   06A2 20202020202020202020202020202020
0240   06B1 222222222222 .BYTE 22H,22H,22H,22H,22H,22H,22H,22H,22H,
                         22H,22H,22H,22H,22H,22H,22H,22H,22H,22H,22H
0240   06B7 22222222222222222222222222222222
0241   06C5 232323232323 .BYTE 23H,23H,23H,23H,23H,23H,23H,23H,23H,
                         23H,23H,23H,23H,23H,23H,23H,23H,23H,23H,23H
0241   06CB 23232323232323232323232323232323
0242   06D9 1C1C1C1C1C1C .BYTE 1CH,1CH,1CH,1CH,1CH,1CH,1CH,1CH,1CH,
                         1CH,1CH,1CH,1CH,1CH,1CH,1CH,1CH,1CH,1CH,1CH
0242   06DF 1C1C1C1C1C1C1C1C1C1C1C1C1C1C
0243   06ED 141414141414 .BYTE 14H,14H,14H,14H,14H,14H,14H,14H,14H,
                         14H,14H,14H,14H,14H,14H,14H,14H,14H,14H,14H
0243   06F3 14141414141414141414141414141414
0244   0701 101010101010 .BYTE 10H,10H,10H,10H,10H,10H,10H,10H,10H,
                    10H,10H,10H,10H,10H,10H,10H,10H,10H,10H,10H,10H
0244   0707 10101010101010101010101010101010
0245   0717 121212121212 .BYTE 12H,12H,12H,12H,12H,12H,12H,12H,12H,
                    12H,12H,12H,12H,12H,12H,12H,12H,12H,12H,12H
0245   071D 12121212121212121212121212121212
0246   072B 131313131313 .BYTE 13H,13H,13H,13H,13H,13H,13H,13H,13H,
                    13H,13H,13H,13H,13H,13H,13H,13H,13H,13H,13H
0246   0731 13131313131313131313131313131313
0247   073F 0C0C0C0C0C0C .BYTE 0CH,0CH,0CH,0CH,0CH,0CH,0CH,0CH,0CH,
                    0CH,0CH,0CH,0CH,0CH,0CH,0CH,0CH,0CH,0CH,0CH,0CH
0247   0745 0C0C0C0C0C0C0C0C0C0C0C0C0C0C0C
0248   0754 040404040404 .BYTE 04H,04H,04H,04H,04H,04H,04H,04H,04H,
                    04H,04H,04H,04H,04H,04H,04H,04H,04H,04H,04H,04H
0248   075A 04040404040404040404040404040404
0249   076A 000000000000 .BYTE 00H,00H,00H,00H,00H,00H,00H,00H,00H,
                    00H,00H,00H,00H,00H,00H,00H,00H,00H,00H,00H,00H
0249   0770 00000000000000000000000000000000
0250   0780 020202020202 .BYTE 02H,02H,02H,02H,02H,02H,02H,02H,02H,
                         02H,02H,02H,02H,02H,02H,02H
0250   0786 02020202020202020202
0251   078F 020202020202 .BYTE 02H,02H,02H,02H,02H,02H,02H,02H,02H
0251   0795 020202
0252   0798 030303030303 .BYTE 03H,03H,03H,03H,03H,03H,03H,03H,03H,03H
                         ,03H,03H,03H,03H,03H,03H,03H
0252   079E 03030303030303030303
0253   07A9 030303030303 .BYTE 03H,03H,03H,03H,03H,03H
0254   07AF BCBCBCBCBCBC .BYTE 0BCH,0BCH,0BCH,0BCH,0BCH,0BCH,
                         0BCH,0BCH,0BCH,0BCH
0254   07B5 BCBCBCBCBCBCBCBCBCBCBCBCBCBCBCBC
0255   07B9 BCBCBCBCBCBCBCBCBCBCBCBCBCBCBCBC .BYTE 0BCH,0BCH,0BCH,0BCH,0BCH,0BCH,0BCH,
                         0BCH,0BCH,0BCH,0BCH,0BCH,0BCH,0BCH
0255   07BF BCBCBCBCBCBCBCBCBCBCBCBCBCBCBCBC
0256   07C7 B4B4B4B4B4B4 .BYTE 0B4H,0B4H,0B4H,0B4H,0B4H,0B4H,0B4H,
                    0B4H,0B4H,0B4H,0B4H,0B4H,0B4H,0B4H,0B4H,0B4H,0B4H
0256   07CD B4B4B4B4B4B4B4B4B4B4B4B4B4B4B4
0257   07D9 B4B4B4B4B4   .BYTE 0B4H,0B4H,0B4H,0B4H,0B4H
0258   07DE B0B0B0B0B0B0 .BYTE 0B0H,0B0H,0B0H,0B0H,0B0H,0B0H,0B0H,
                         0B0H,0B0H,0B0H,0B0H,0B0H,0B0H,0B0H,
                         0B0H,0B0H,0B0H,0B0H,0B0H,0B0H,0B0H,0B0H
0258   07E4 B0B0B0B0B0B0B0B0B0B0B0B0B0B0B0B0B0
0259   07F4 B2B2B2B2B2B2 .BYTE 0B2H,0B2H,0B2H,0B2H,0B2H,0B2H,
```

```
                                0B2H,0B2H,0B2H,0B2H,0B2H,0B2H,0B2H,0B2H
0259    07FA B2B2B2B2B2B2B2B2
0260    0802 B2B2B2B2B2B2  .BYTE 0B2H,0B2H,0B2H,0B2H,0B2H,0B2H,
                                0B2H,0B2H,0B2H
0260    0808 B2B2B2
0261    080B B3B3B3B3B3B3  .BYTE 0B3H,0B3H,0B3H,0B3H,0B3H,0B3H,0B3H,
                                0B3H,0B3H,0B3H,0B3H,0B3H
0261    0811 B3B3B3B3B3B3
0262    0817 B3B3B3B3B3B3  .BYTE 0B3H,0B3H,0B3H,0B3H,0B3H,0B3H,0B3H,
                                0B3H,0B3H,0B3H,0B3H,0B3H,0B3H,0B3H,0B3H,0B3H
0262    081D B3B3B3B3B3B3B3B3B3B3
0263    0827            .END
0264    0827
0265    0827
0266    0827
0267    0827
0268    0827
```

An example of the software program utilized by device 10 is shown in the above accompanying pages and operates the device 10 during use. The Z80 microprocessor chip 80 utilizes a binary code of the above program that may be created by a number of commercially available compilers or assemblers.

Program lines 1–61 activate all of the LEDs 18 in order to determine if any are burnt out and not functioning. The program loops through lines 1–61 for approximately one and one-half seconds. During such initial turn ON of device 10, it would appear to the casual observer that LEDs 18 are all illuminated at the ON stage.

The next section of the program are lines 62–71 in which I/O parallel port chip 64 is initialized. The next step (line 72) is to clear the input flip flop, i.e., divide by two IC chip 54 and reset counter IC chips 60 and 62 to zero. Line 74 turns ON bit 5 of output port C for enablement of status checking, if necessary, during initial trouble shooting of device 10 during assembly.

At line 77 of the program, microprocessor 80 checks the input of Q-not (electrical line 68), and determines whether or not it is high. The microprocessor 80 waits until Q-not goes low which means that Q would be high, and which indicates that counter IC chips 60 and 62 are ready to begin counting. When Q-not is low again, the counters are running, i.e., counter IC chips 60 and 62 as described at program line 86. The program then tests for counter overflow at lines 87, 88.

Counter IC chips 60 and 62 are kept running for one full input cycle until Q-not its high once more (program lines 90–91). At that time, the program turns OFF counter IC chips 60 and 62 then the raw frequency count data is passed into register DE of microprocessor 80 (program lines 96–99).

Program lines 101 through 104 test whether or not register DE is greater than or less than a particular number to make sure that the information is within the numerical bounds of a valid signal count. If the information in register DE is out of bounds, then the program is reset with a new data sample, line 104. If the register DE is valid, a second data sampling is taken.

A second sampling is taken, as shown in program lines 106 through 134, in which the input flip flop, i.e. divide by two IC chip 54 and counter IC chips 60 and 62 are reset (lines 106), and the inputs Q and Q-not are tested as before. In this second sampling, the raw frequency data count is placed into register HL of microprocessor 80. The register DE contains the first valid sample, while HL contains a second subsequent valid data sample.

The next step of the program is to compare the most significant bit of the first (DL) and second (HL) samples; and if they are the same, this signifies that the two samples DE and HL are reasonably close and are then determined to be valid voice data samples. This compare step acts as a filter to ensure that the data samples are substantially of the same chromatic note.

At that point, the two data samples are substantially on the same chromatic note (lines 136–138). If the comparison above is true, i.e., that the first and second syllable are reasonably close, then the low order bits are averaged together (lines 140–145). This accomplishes the task of eliminating voice vibrato effects that may be detected in a signal that would not be able to be displayed by the system. The calculated average number is then placed back into the HL register. Lines 147 through 160 of the program divide the value found in the HL register by two until that number is less than a predetermined value, in this case 2,047. The look up map attached to microprocessor 80 and physically found in EPROM chip 82, i.e., lines 162–170 is now referenced with this divided number. If the Hl register is already less than 2,047, no division step occurs.

The value of the chromatic note found by the divided number is used by microprocessor 80 to index into the look up table encoded with EPROM chip 90. The number found with the index is a particular output (i.e, a display pattern) for microprocessor 80 to illuminate particular LEDs 18. The number of divisions caused by the indicator may indicate a chromatic octave of the initial vocal note or data inputted.

Utilization of only 2,047 entries into the look up table enables simple math to describe the chromatic scale. The reason that the number for division of the chromatic notes go or are held beneath 2,100 is that the human ear can be trained to distinguish pitches which are at only greater than 10 percent of a particular pitch. In other words, a human ear does not discern any difference of pitch to less than a variance of ±10 percent. At the range of 10 to 20 percent from the initial perfect pitch is where human hearing can just determine that the pitch is (OFF). Each physical frequency available for the device 10 to look at for a particular count has to have an address of corresponding data, lines 170 through 262. As described by lines 165 and 166, the divided value is stored in the HL register. The address pointed to by the HL register, i.e., the looked up value from EPROM chip 90 data table, is then loaded into register A where it is sent to latch IC 100. This outputs the value to the register of the latch IC 100 which then causes particular LEDs 18 to become illuminated as described above. At that time the program at line 167 passes control back up to line 72, which instructs microprocessor 80 to clear the divide by two IC chip 54 and reset counter IC chips 60 and 62 to begin the note determining process once more.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A vocal note indicating device for indicating the note of a vocal pitch signal, comprising:

an amplifying means for amplifying an inputted vocal pitch signal;

a square wave generator means, responsive to the vocal pitch signal from said amplifying means, for providing a square wave output signal substantially having a same period as the vocal pitch signal;

a timer means for determining the period of said square wave, said timer means providing an output indicating a period of said square wave output signal;

a microprocessor having a look-up table associated therewith, said microprocessor comparing said output from said timer means with said look-up table to provide an output indicating the note and degree of at least one of sharpness and flatness of the vocal pitch signal; and a display means including a plurality of columns of LEDs, each said column utilized for displaying a separate possible note of the vocal pitch signal, said note being displayed as at least one illuminated LED from a said column of LEDs, said degree of sharpness or flatness being represented as other illuminated LEDs in the same column.

2. The device of claim 1 in which said square wave generator means creates a change of state of output square wave when the vocal pitch signal is at one of positive 0.25 volts and negative 0.25 volts from a zero crossover.

3. The device of claim 1 in which said square wave generator is a Schmitt trigger.

4. The device of claim 1 in which said display means includes green and red LEDs.

5. The device of claim 4 in which said green LEDs are illuminated when a particular voice pitch signal is input representing that the voice pitch signal is within a predetermined tolerance, said red LEDs illuminated when a particular voice pitch signal is input representing that the voice pitch signal is outside a predetermined tolerance.

6. The device of claim 1 wherein said square wave generator means and said amplifier means substantially reject non-voice pitch signals.

7. A vocal note indicating device for indicating the note of a vocal pitch signal, comprising:

an amplifying means for inputting and amplifying the vocal pitch signal to the device;

a square wave generator means, responsive to the vocal pitch signal from said amplifying means, for providing a square wave output signal substantially having a same period as the vocal pitch signal;

a timer means for determining the period of said square wave, said timer means providing an output indicating a period of said square wave output signal, said timer means output having a significant bit and less significant bits;

a microprocessor having a look-up table associated therewith, said microprocessor obtaining the output of said timer means and then comparing two subsequent outputs of said timer means to determine if said two subsequent outputs have the same pre-selected significant bit, said microprocessor averaging said less significant bits of said two subsequent outputs, said microprocessor taking said averaged less significant bits and said significant bit of said two subsequent timer means outputs and indexing into said look-up table to provide an output indicating the note and degree of at least one of sharpness and flatness of the vocal pitch signal; and a display means for displaying the note of the vocal pitch signal, said display means including a plurality of columns of LEDs, each said column utilized for displaying a separate possible note of the vocal pitch signal, said note being displayed as at least one illuminated LED from a said column of LEDs, said degree of sharpness or flatness being represented as other illuminated LEDs in the same column.

8. The device of claim 7 in which said square wave generator means creates a change of state of output square wave when the vocal pitch signal is at one of positive 0.25 volts and negative 0.25 volts from a zero crossover.

9. The device of claim 7 in which said square wave generator is a Schmitt trigger.

10. The device of claim 7 in which said display means includes green and red LEDs.

11. The device of claim 10 in which said green LEDs are illuminated when a particular voice pitch signal is input representing that the voice pitch signal is within a predetermined tolerance, said red LEDs illuminated when a particular voice pitch signal is input representing that the voice pitch signal is outside a predetermined tolerance.

12. The device of claim 7 wherein said square wave generator means and said amplifier means substantially reject non-voice pitch signals.

13. A method of determining the note of a voice pitch signal, comprising the steps of:

amplifying the voice pitch signal;

converting the amplified voice pitch signal to a square wave having substantially the same period as the voice pitch signal;

determining the period of two subsequent square wave signals;

storing said two subsequent square wave signals in registers;

comparing the most significant bit of said two subsequent square wave signals and accepting said signals if said most significant bits are the same;

averaging the least significant bits of said two subsequent square waves and storing them with the accepted most significant bit in a register;

indexing with said most significant and said averaged least significant bits into a look up table to obtain a display pattern which indicates the note and pitch of the voice pitch signal; and sending said display pattern to a display device to display the note and pitch of the voice pitch signal.

* * * * *